United States Patent [19]

Lucas

[11] 4,257,837

[45] Mar. 24, 1981

[54] SEAL SPLICE

[75] Inventor: George A. Lucas, Rockmart, Ga.

[73] Assignee: Goodyear Aerospace Corporation, Akron, Ohio

[21] Appl. No.: 124,415

[22] Filed: Feb. 25, 1980

[51] Int. Cl.[3] ..... B32B 31/12; B32B 3/02

[52] U.S. Cl. ..... 156/153; 156/157; 156/267; 156/304.3; 156/307.1; 220/216; 428/58; 428/61; 428/128; 428/189

[58] Field of Search ..... 156/157, 153, 304.3, 156/307.1, 267; 428/129, 61, 60, 58, 128, 189, 192; 220/216, 221, 222, 224

[56] References Cited

U.S. PATENT DOCUMENTS

| | | | |
|---|---|---|---|
| 3,240,381 | 3/1966 | Smith | 220/216 |
| 3,338,454 | 8/1967 | Nelson | 220/224 |
| 4,099,643 | 7/1978 | Wardwell et al. | 220/222 |

FOREIGN PATENT DOCUMENTS

| | | | |
|---|---|---|---|
| 37-6144 | 5/1962 | Japan | 156/304.3 |

*Primary Examiner*—Paul J. Thibodeau
*Attorney, Agent, or Firm*—L. A. Germain; P. E. Milliken

[57] ABSTRACT

A splicing unit for integrally joining ends of seal strip material to form a continuous annular seal ring comprises two reinforced elastomeric ply strips with an unreinforced elastomeric gum interposed between them to form an H-section configuration, the length of the unit being substantially the width of the seal strip while the depth of the gum between the ply strips is substantially the thickness of the seal material to be joined. The ends of the seal strip are inserted between the legs of the H-section on either side of the unreinforced gum and cured to form the integrally spliced seal ring.

5 Claims, 4 Drawing Figures

SEAL SPLICE

BACKGROUND OF THE INVENTION

This invention generally relates to splices as may be applied to flexible elastomeric articles, and more particularly to a unit splice configuration for splicing a floating roof tank secondary seal into a continuous annular sealing ring.

Floating roofs for large storage tanks which hold volatile liquid products are well known and understood in the art as are the seals that close up the free space between the floating roof and the vertical tank wall. These seals generally comprise a primary seal that is attached to the periphery of the floating roof and which reacts with the tank wall to centrally locate the roof within the confines of the tank while also providing a sliding seal conforming to the wall surface as the liquid level in the tank changes. A secondary seal is also provided which is generally referred to as a "weather seal" because it is designed to protect the more complicated primary seal from contamination by foreign material such as dirt, dust, water, snow and ice, and the like. The secondary seal is usually therefore located above the primary seal and is mounted in a manner to also conform to the tank wall as the floating roof moves in response to changing liquid levels. Primary and secondary sealing techniques and configurations of the type alluded to are described in the prior art as exemplified by the U.S. patents to A. H. Nelson (No. 3,338,454), Wardell et al (No. 4,099,643), and R. A. Bruening (No. 4,126,243).

Secondary seals currently in use come in a variety of arrangements and generally comprise a configuration of elastomeric and/or polmeric materials which may or may not include an embedded reinfocement material. Because of the large circumferencial extent of floating roof type tanks, the seals are made up of a plurality of seal strip lengths which are spliced together to form the substantially annular seal ring when mounted to the roof structure. Conventionally, the seal strips are butt joined and the joint is cemented and covered over with a ply of reinforcement material. This procedure has resulted in misalignment of the spliced butt ends which affects the sealing integrity of the annular secondary seal as it attempts to conform to the inner wall of the tank.

This invention therefore is directed to a splice configuration for floating roof secondary seals that may be factory fabricated in various lengths according to the width of the seal material to be spliced, applied in the field, and air cured or vulcanized to provide an integrally spliced secondary seal.

An aspect of one object of the invention is to provide a splice for floating roof tank secondary seals that facilitates proper alignment of the spliced seal strips such that the completed annular seal more closely conforms to the inner tank wall to effect a proper seal therebetween.

The invention therefore provides an integrally vulcanized splicing unit for connecting ends of seal material such as to create an annular seal ring comprising:

a first reinforced elastomeric ply strip having a central longitudinal axis and a length substantially greater than its width and juxtaposed to the first ply strip such that the longitudinal axes are algned in a vertical plane; and an unreinforced elastomeric gum interposed between the first and second ply strips for the length thereof and having a width less than the widths of the ply strips and centrally positioned between the ply strips along their longitudinal axes such as to form a unit having an H-section configuration with length-wise slots on either side thereof for receiving the ends of the seal material therein.

BRIEF DESCRIPTION OF THE DRAWING

The invention will be best understood from a consideration of the following detailed description taken in conjunction with the accompanying drawing wherein.

Figure 1:
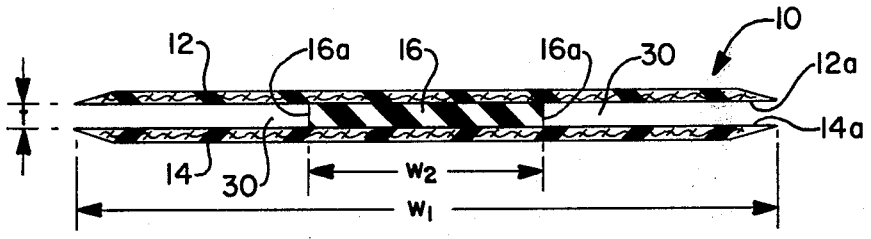
FIG. 1 is a cross-section elevational view of the integrally formed splicing unit forming the basis of the invention.

Referring to the drawing figures, a splicing unit in accordance with the invention is generally indicated by reference numeral 10. The unit 10 is a prefabricated and integrally vulcanized elastomeric strip manufactured in various lengths according to the width of the seal material to be joined and having an H-pattern cross-sectional configuration and a section width designated $W_1$. The splicing unit, when made to a specific length, comprises a ply strip 12 forming one side of the H-section, a ply strip 14 forming the opposite side, and a layer 16 interposed between the sides 12 and 14 to form the center of the H-section.

The elongated plys 12 and 14 comprise a fabric reinforced elastomeric material that establish the width $W_1$ of the unit 10 while the interlayer 16 is an elongated unreinforced elastomeric gum ply having a width $W_2$ that is substantially less than the width $W_1$ of the unit 10. The interlayer gum 16 is centrally oriented along the longitudinal axis 18 of the plys 12 and 14 such that the difference in width forms slots 30 running longitudinally along either side of the unit 10 for the length thereof. The slots 30 thus formed are bounded on one side by an inner surface **12*a* of the ply strip material 12, on the opposite side by the inner surface 14*a* of ply strip material 14, and at the center by the exposed edge 16*a* of the gum interlayer 16. In this H-section configuration the interlayer gum 16 may comprise 25–80 percent of the total unit width $W_1$ and for most splicing applications will preferably be within 30–50 percent of the width $W_1$. The interlayer gum 16 will also have a thickness "t" that is dependent upon the thickness of the seal material 20 to be joined by splicing and therefore will vary according to the particular requirements. For splicing most secondary seal materials the ratio of the length "x" for each leg of the slot 30 to the thickness "t" must be at least 8 to 1.0. In this respect, for greater thicknesses of material the distance "x" will have to be proportionally increased in relation to thickness "t" to provide adequate bonding surface at 12*a* and 14*a*** for effecting the splice.

The interlayer 16 is an unreinforced elastomeric and/or polymeric gum exhibiting a durometer within the range 65–75. In this circumstance the gum allows for greater tolerance allowances between the ends 22 and 24 of the seal material to be joined as the ends are inserted into the slots 30 formed by the H-section, which ends 22,24 ultimately abutt the gum 16 at the exposed surfaces 16*a*.

Figure 2:
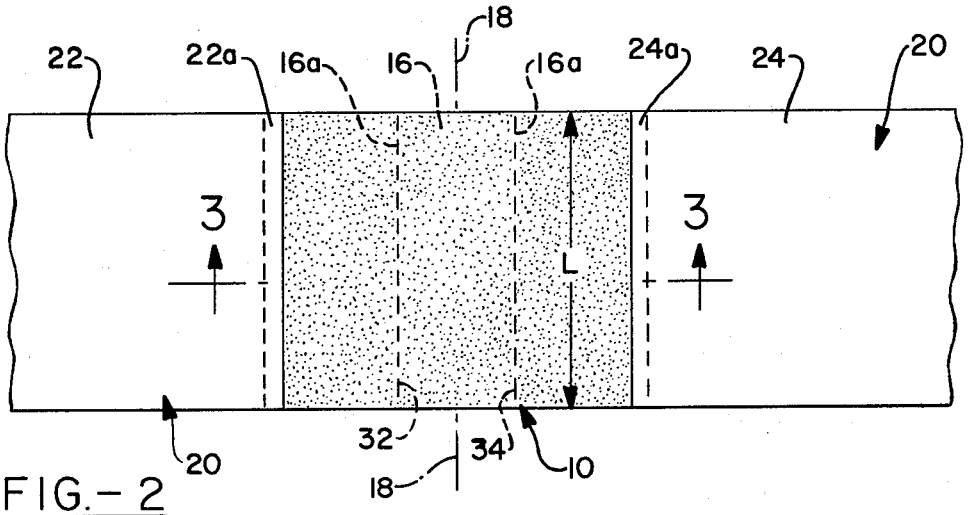
FIG. 2 is a plan view of a floating roof tank secondary seal incorporating the splice illustrated in FIG. 1.
Figure 3:
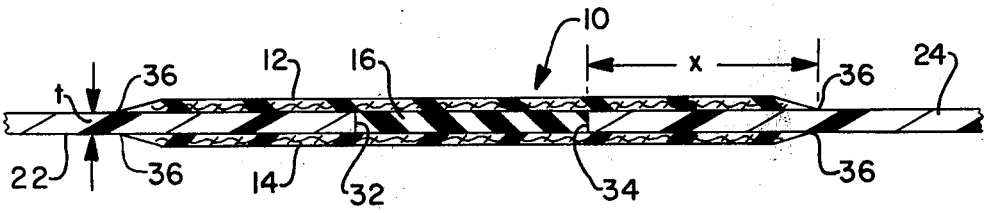
FIG. 3 is an elevational view as taken on line 3—3 of FIG. 2.

Referring to FIGS. 2 and 3, splicing of the seal strip 20 is effected by first buffing the butt ends 22 and 24 in the area of the splice until the surfaces are well roughened. The roughened area is extended at least ⅛ inch wider than the splicing material 10 such as indicated at 22*a* and 24*a*. The buffed areas are then washed with a solvent to remove all foreign matter and multiple coats of an appropriate cement are applied and allowed to dry to a tackiness. The butt ends 22,24 are then inserted into the slots 30 until they abutt the interlayer 16 at 16*a*. The splice is then thoroughly rolled in the cemented areas to remove any trapped air and an additional amount of cement is applied to the raw edges at 36 to completely seal the edged interface. The spliced seal strip is then cured before being put into service. Curing of the spliced seal strip may be accomplished in various ways. For example, the splice may be air cured when an appropriate air-cure type adhesive is used. In this circumstance, a field splicing operation with an air cure will require approximately an 8-hour cure time. Alternatively, in those instances where a facility is available, the spliced seal strip may be vulcanized in the usual manner of vulcanization processes to integrally bond the elements of the splicing unit 10 to the seal material 20.

Figure 4:
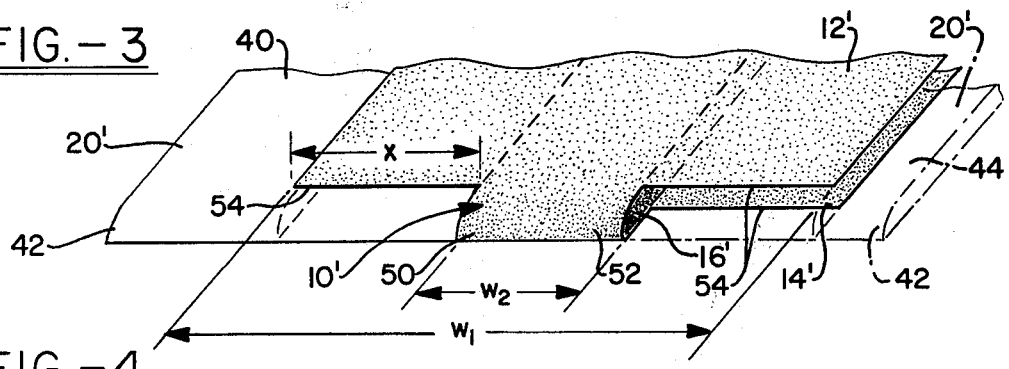
FIG. 4 is a partial perspective view illustrating the application of the invention to a seal having tapered lateral edges.

Referring now to FIG. 4, a portion of one end 40 of a seal 20' having tapered lateral edges 42 is shown connected into one side of a splicing unit 10', the opposite end 44 of the seal 20' being illustrated in ghost lines for the purpose of clarity in the drawing. In this configuration, the splicing unit 10' is made to an exact length "L" equal to the width of the seal 20' and is vulcanized in a mold such that the ends 50 conform to the taper of the seal edges 42. Thus, the reinforced ply strips 12' and 14' are integrally joined at the end 50 with very little unreinforced gum 16' between them. The splicing unit 10' therefore, is formed with closed ends 50 for the width $W_1$ of the unit and in order for the ends 40 and 44 of the seal 20' to be inserted between the plys 12', 14' the ends 50 must be trimmed for the length "x" to form the H-section. The width $W_2$ of the end in the area of the gum 16' is left intact and when this is done the tapered edge 42 of the seal 20' exactly conforms to and abutts the tapered portion 52 of the splicing unit 10'. An advantage to this is that the edges 54 of ply strips 12' and 14', for the length "x" forming the legs of the H-section, are positioned away from the tapered edges 42,52 so as not to interfere with any wiping action made in effecting a sealing relationship.

It will be appreciated from the foregoing that the preformed splice strip provides a distinct advantage over the prior splicing techniques for floating roof tank secondary seals, in that ends 22,24 are not subject to misalignment by reason of their edges 32,34 being butt joined in the splice. In this respect, the gum 16 cancels discontinuities between the butt edges 32,34 and allows for proper alignment of the lengths 22,24 to form an annular ring which conforms more to the interior curvature of the tank wall.

It will be further appreciated that because the splice strip 10 is a prefabricated and preformed length of material, it decreases secondary seal splice failures by reason of the fact that the splice configuration is uniform and the splicing technique followed is always the same.

While certain representative embodiments and details have been shown for the purpose of illustrating the invention, it will be apparent to those skilled in the art that various changes and modifications may be made therein without departing from the spirit or scope of the invention.

What is claimed is:

1. A method of splicing ends of material forming an annular floating roof tank secondary seal comprising the steps of:

(a) providing a length of an integrally vulcanized splicing unit substantially matching the width of the seal material to be joined by splicing and an H-section configuration comprised of fabric reinforced elastomer forming the sides and reinforced elastomeric gum interposed between the sides and forming the central cross member of the H-section.

(b) buffing the ends of the seal material to roughen the exposed surfaces thereof in the area to be spliced and cleaning the roughened areas with a solvent to remove any foreign and loose material;

(c) applying multiple coats of an appropriate adhesive to the roughened areas;

(d) inserting the ends of the seal material into the open ends of the H-pattern of the splicing unit until the ends abutt the unreinforced gum;

(e) rolling the spliced area to remove any air bubbles; and (f) curing the spliced seal.

2. The method as set forth in claim 1 wherein the elastomeric gum interposed between the reinforced elastomeric sides forming the splicing unit is characterized by a cross-sectional width within the range of 25–50 percent of the total width of the splicing unit and a durometer within the range 65–75.

3. The method as set forth in claim 2 wherein the adhesive is air curable and the spliced seal is allowed to air cure for at least 8 hours.

4. The method as set forth in claim 2 wherein the adhesive is heat curable and the spliced seal is heat and pressure vulcanized.

5. The method as set forth in claim 1 wherein the tank seal is characterized by tapered lateral edges and the splicing unit is formed with closed ends having a taper substantially conforming to the taper of the lateral edges of the seal material and the method further comprises the step of trimming the ends of the splicing unit except in the area of the unreinforced gum such that the inserted ends of the seal material abutt the gum and the taper of the seal edge and the taper of the unit end are in a matched relationship.

* * * * *

UNITED STATES PATENT OFFICE

CERTIFICATE OF CORRECTION

Patent No. 4,257,837 Dated March 24, 1981

Inventor(s) George A. Lucas

It is certified that error appears in the above-identified patent and that said Letters Patent are hereby corrected as shown below:

Col.1, line 67, "algned" should read --aligned--.

Claim 1, line 8, "reinforced" should read --unreinforced--; and at line 10, the period at the end of the line should be a semi-colon --;--.

Signed and Sealed this

*Sixteenth* Day of *June 1981*

[SEAL]

*Attest:*

RENE D. TEGTMEYER

*Attesting Officer* *Acting Commissioner of Patents and Trademarks*